United States Patent [19]

Obey

[11] 4,428,498

[45] Jan. 31, 1984

[54] COFFEE CUP TRAVEL LID

[76] Inventor: Richard P. Obey, 5 Warden St., Apt. 16, Saugus, Mass. 01906

[21] Appl. No.: 392,794

[22] Filed: Jun. 28, 1982

[51] Int. Cl.[3] ..... B65D 41/26; B65D 47/32; B65D 43/03

[52] U.S. Cl. ..... 220/367; 206/508; 220/90.4; 220/270; 220/380; 222/527; 229/7 R; 229/7 S

[58] Field of Search ..... 222/529, 527; 220/254, 220/270, 90.2, 90.4, 367, 380; 229/7 S, 7 R, 43; 206/508

[56] References Cited

U.S. PATENT DOCUMENTS

| | | | |
|---|---|---|---|
| 2,202,652 | 5/1940 | Glidden | 221/11 |
| 2,276,577 | 3/1942 | Hahn | 229/7 |
| 2,569,139 | 9/1951 | Abelson | 220/90.2 X |
| 3,298,577 | 1/1967 | Chlystun | 222/529 |
| 3,335,901 | 8/1967 | Edwards | 220/380 X |
| 3,403,812 | 10/1968 | Weber | 220/60 |
| 3,481,515 | 12/1969 | Booth et al. | 222/529 |
| 3,616,961 | 11/1971 | Mallorca | 220/54 |
| 3,690,522 | 9/1972 | Chlystun | 222/529 |
| 3,773,243 | 11/1973 | Green | 220/90.2 X |
| 3,800,999 | 4/1974 | Serritella | 229/7 R |
| 3,856,187 | 12/1974 | Chlystun | 222/529 |
| 3,868,043 | 2/1975 | Freemyer | 220/90.4 |
| 3,933,264 | 1/1976 | Rossi | 215/254 |
| 3,938,695 | 2/1976 | Ruff | 220/90.4 |
| 3,977,559 | 8/1976 | Lombardi | 220/90.4 |
| 3,994,411 | 11/1976 | Elfelt et al. | 220/90.4 |
| 4,000,838 | 1/1977 | Bogert | 222/529 |
| 4,027,811 | 6/1977 | Chlystun | 222/529 |
| 4,056,210 | 11/1977 | Boyle | 220/90.4 |
| 4,073,413 | 2/1978 | Tabler et al. | 222/529 |
| 4,082,827 | 4/1978 | Chlystun | 264/98 |
| 4,085,861 | 4/1978 | Ruff | 220/90.4 |
| 4,095,728 | 6/1978 | Chlystun | 222/529 |
| 4,113,135 | 9/1978 | Yamazaki | 220/90.4 X |
| 4,184,604 | 1/1980 | Ambers et al. | 220/90.4 X |
| 4,215,793 | 8/1980 | Packard | 220/270 |
| 4,303,170 | 12/1981 | Panicci | 220/90.4 X |

FOREIGN PATENT DOCUMENTS

| | | | |
|---|---|---|---|
| 2920159 | 11/1980 | Fed. Rep. of Germany . | |
| 741427 | 12/1955 | United Kingdom | 222/529 |

*Primary Examiner*—Allan N. Shoap

[57] ABSTRACT

A travel lid for a disposable coffee cup useful in place for drinking coffee while the user is moving. The lid has a continuous rim adapted to grip the upper rim of a disposable coffee cup and a top closing surface. On one side of the closing surface there is an expansible coffee-sipping port element shaped and positioned to be received by the mouth. On the opposite side of the closing surface there is a vent formation. The expansible coffee sipping port element, in the condition supplied to the server of coffee, is of vertically collapsed configuration with its upper end disposed below the upper edge of the continuous rim. The sipping port element in the collapsed position provides clearance sufficient to enable the lid to be compactly stacked with other lids of identical form for shipment and dispensing. The expansible sipping port element is constructed to respond to an outward pulling action to extend above the rim to a position exposed for contact with the mouth, enabling coffee to be sipped therefrom upon tipping of the cup. The vent is disposed sufficiently away from the center of the top closing surface in the direction opposite from the coffee sipping port to prevent coffee spillage therethrough during drinking from the coffee sipping port element. The coffee sipping port element is sized and shaped to enable gradual flow of coffee therethrough upon tipping of the coffee cup to which it is attached.

4 Claims, 8 Drawing Figures

FIG 1
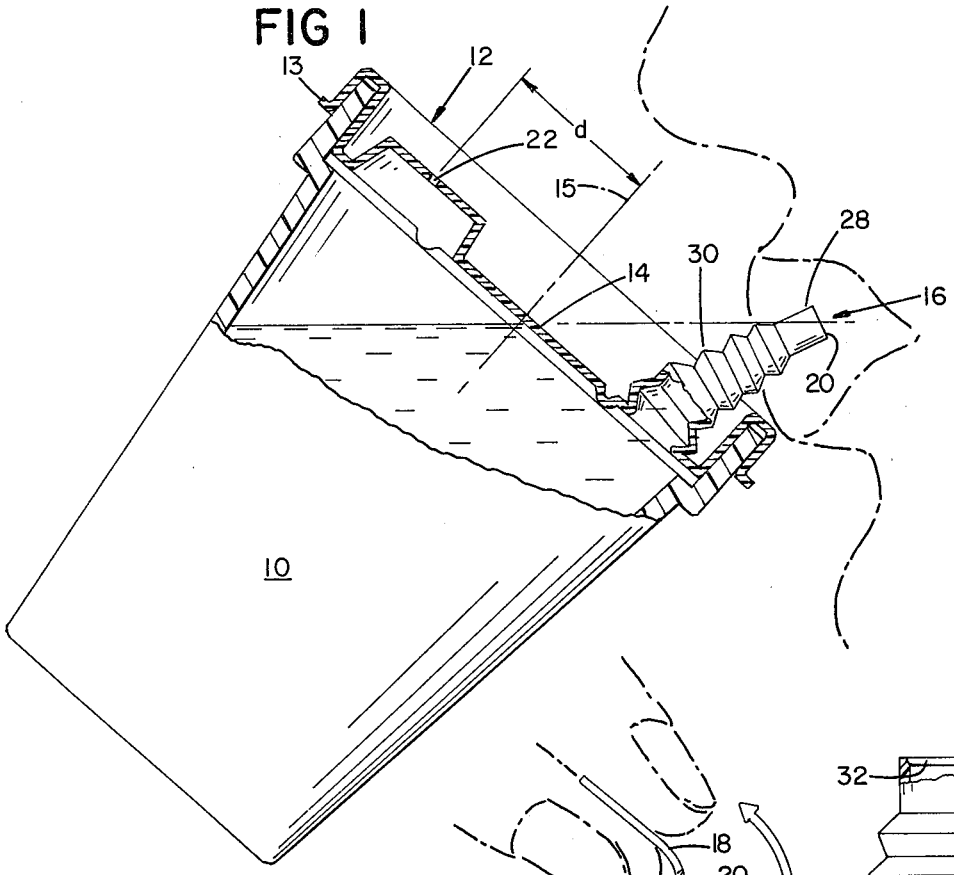
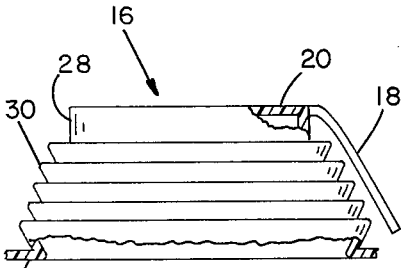
FIG 6
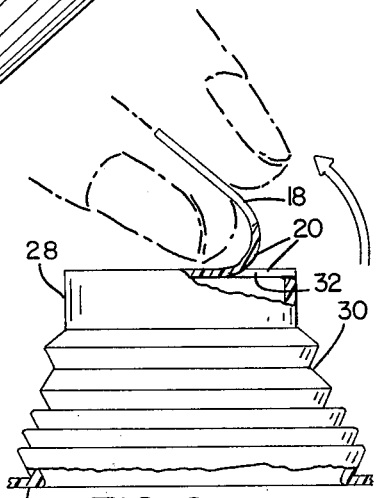
FIG 6a
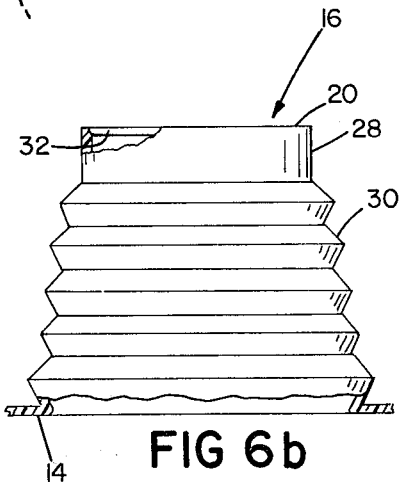
FIG 6b
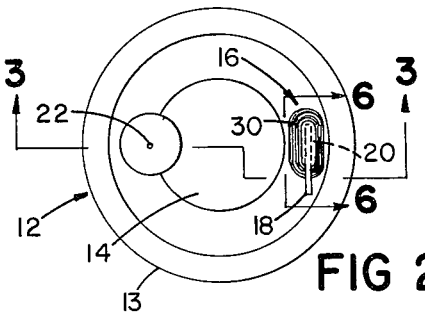
FIG 2
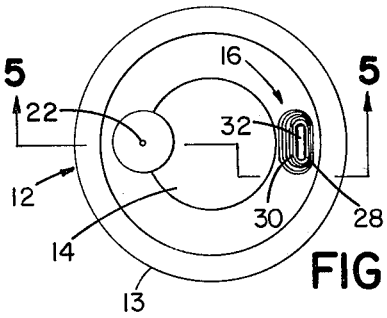
FIG 4
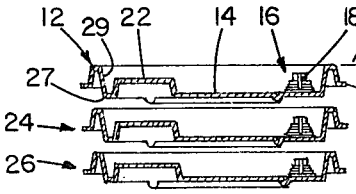
FIG 3
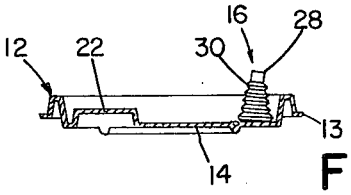
FIG 5

COFFEE CUP TRAVEL LID

BACKGROUND OF THE INVENTION

This invention relates to a travel lid for a disposable coffee cup.

It is a common practice for people to attempt to drink coffee from disposable coffee cups while traveling in cars or otherwise under moving conditions. Often people remove the lids from their coffee cups before they try to sip from them. This can result in spilling the coffee, burns to the mouth, and loss of heat of the coffee. Another alternative has been that people have torn rough holes in the sides of the lid. Such tearing is difficult to accomplish on a plastic lid and the lid is usually left in a structurally weakened state. Also, such a hole can have sharp edges and would not be sanitary.

SUMMARY OF THE INVENTION

The invention relates to a travel lid for a disposable coffee cup useful in place for drinking coffee while the user is moving.

According to the invention the lid has a continuous rim adapted to grip the upper rim of a disposable coffee cup and a top closing surface, on one side of the closing surface there being an expansible coffee-sipping port element shaped and positioned to be received by the mouth, and on the opposite side of the closing surface there being a vent formation, the expansible coffee sipping port element, in the condition supplied to the server of coffee, being of vertically collapsed configuration with its upper end disposed below the upper edge of said continuous rim, the sipping port element in said collapsed position providing clearance sufficient to enable the lid to be compactly stacked with other lids of identical form for shipment and dispensing, the expansible sipping port element being constructed to respond to an outward pulling action to extend above the rim to a position exposed for contact with the mouth, enabling coffee to be sipped therefrom upon tipping of said cup, the vent being disposed sufficiently away from the center of said top closing surface in the direction opposite from said coffee sipping port to prevent coffee spillage therethrough during drinking from said coffee sipping port element, the coffee sipping port element being sized and shaped to enable gradual flow of coffee therethrough upon tipping of the coffee cup to which it is attached.

In preferred embodiments, the coffee-sipping port element is elongated in the tangential direction of the lid, preferably the longitudinal wall of the coffee-sipping port element, on the inward side of the coffee cup lid, slopes upwardly outwardly when in the extended position while the outward side of the coffee sipping element is substantially vertical; and the sipping port element is formed integrally with the top closing surface and the continuous rim.

The travel lid of the invention allows a coffee drinker to easily drink coffee from an expansible coffee sipping port element. The structure of the lid allows it to be compactly stacked on top of other identical lids so that it is easy to ship and use and is kept free from damage before use. Once the lid is placed on a coffee cup one pull of the pull tab secured to the port element both expands the port and opens the port for drinking. The coffee drinker can wait until he has begun to travel before pulling the tab. Once the coffee sipping port is expanded, coffee may be easily sipped through the port by tipping the cup. Accidental spillage of coffee is virtually eliminated. An air vent positioned on the opposite side of the lid from the port allows venting without coffee being spilled from it. The sipping port is maintained in a sanitary condition until the coffee drinker chooses to open the port by pulling the tab. The problem of sharp edges is eliminated because the pulling of the tab reveals a smooth edged mouthpiece element.

Other advantages and features of the invention will be apparent from the following description of the preferred embodiments thereof, and from the claims.

DESCRIPTION OF THE PREFERRED EMBODIMENT

We first briefly describe the drawings.

DRAWINGS

FIG. 1 shows a view of the invention in use.

FIG. 2 is a top view of the travel lids.

FIG. 3 is a partially cutaway view of three travel lid taken along line 3—3 showing the port element collapsed and stacking.

FIG. 4 is a top view of the travel lid showing the port element expanded.

FIG. 5 is a partially cutaway view of the lid taken along line 5—5 showing the port element expanded.

FIG. 6 is a side elevation view partially cut away taken along line 6—6 showing the port element collapsed FIG. **6*a* is a side elevation view partially cut away showing the operation of the port element FIG. 6*b*** is a side elevation view showing the port element expanded.

STRUCTURE

Referring to FIG. 1 there is shown coffee cup 10, with travel lid 12, and expansible coffee sipping port 16. The center of vent 22 is located a distance d from centerline 15. The vent is approximately three quarters of the way across the diameter of the lid.

Referring to FIG. 2 there is shown travel 10 lid with continuous rim 13 adapted to grip the upper edge of the coffee cup. Top closing surface 14 forms a flat surface connected to the rim 13. Approximately one quarter of the way across the diameter of the lid is an expansible coffee sipping port 16 with pull tab-tear strip 18 secured to port top 20 which when removed creates opening 32 in the port top.

Referring to FIG. 3, there is shown expansible coffee sipping port 16 in a collapsed position. Port top 20 is positioned below rim 12 allowing another lid to be stacked upon it. Vent 22 is a raised formation which rises midway between top closing surface 12 and rim 10.

Also shown is travel lid 12 with respect to a stack of other identical lids 24 and 26. When bottom stacking corner 27 frictionally engages resilient wall 29. In certain preferred embodiments, the upper portion of the rim element fits into the hollow of an adjacent rim of a lid stacked on top because of the tapered configuration of the rims. When the port element is in its collapsed position the top surface is below the top plane p of the lid and is preferably at the same level as vent formation 22. A portion of the vent formation fits inside the next vent formation because of the tapered configuration of the vent. Due to the geometry described, numerous lids can therefore be stacked very compactly.

Referring to FIGS. 4 and 5 there is shown the travel lid with the pull tab removed. The coffee sipping port 16 is expanded to a height greater than the height of rim 13. Mouthpiece 28 is connected to corrugated element 30. Coffee is sipped through opening 32. The corrugated element, mouthpiece, and tab are all oval shaped.

Referring to FIG. 5 there is shown an enlarged view of the coffee sipping port 16 in an expanded position. Corrugated element 30 is integral with the top closing surface of the lid 14 and with mouthpiece 28.

Referring to FIGS. 6, 6*a*, and 6*b* there is shown expansible port 16 in its collapsed, partially expanded, and fully expanded positions.

OPERATION

When the traveler desires to drink coffee without removing the lid from the cup, pull tab-tear strip 18 is pulled upward, simultaneously removing port top 20 and expanding corrugated element 30 of coffee sipping port 16. Upon tilting the cup toward the traveler, coffee may be sipped through opening 32 in mouthpiece 28. Air may enter through vent 22 to ensure free flow of the coffee.

OTHER EMBODIMENTS

Other embodiments are within the following claims.

What is claimed is:

1. A lid for a disposable coffee cup, useful in place for drinking coffee while the user is moving as while riding in a vehicle, said lid having a continuous rim adapted to grip the upper rim of a disposable coffee cup and a top closing surface, said top closing surface including a vent formation between said continuous rim and the center point of said surface, and including a liquid port on the opposite side of said center point of said surface, said liquid port being adapted to allow liquid to be dispensed from said cup with said lid in place, said vent formation being disposed sufficiently away from said center point in the direction opposite of said liquid port to prevent spillage therethrough during dispensing of coffee from said liquid port, said vent formation being defined by a side wall projecting outwardly from said top closing surface and by a top wall having a vent hole therein, the top surface of said top wall being spaced below the top surface of said rim, said lid with said liquid port and vent formation being configured and adapted to be compactly stacked with other lids of identical form for shipment and dispensing, the improvement wherein said liquid port is an expansible coffee sipping port element shaped and positioned to be received by the mouth, said expansible port element being sized and shaped to provide a conduit means from within said cup to said mouth to enable gradual flow of coffee therethrough without spillage upon tipping of the coffee cup to which it is attached, said lid, in the condition supplied to the server of coffee, having said expansible sipping port element in vertically collapsed configuration with the upper end thereof disposed below the upper edge of said continuous rim, and said sipping port element in said collapsed position providing clearance sufficient to enable said lid to be compactly stacked with other lids of identical form for shipment and dispensing, the top surface of said sipping port element in said collapsed position being in the same plane as the top surface of said top wall of said vent formation, said expansible sipping port element being constructed to respond to an outward pulling action to extend above said rim to a position exposed for contact with the mouth, enabling coffee to be sipped therefrom upon tipping of said cup.

2. The travel lid of claim 1 wherein said coffee-sipping port element is elongated in the tangential direction of said lid.

3. The travel lid of claim 2 in which the longitudinal wall of said coffee-sipping port element, on the inward side of the coffee cup lid, slopes outwardly when in the extended position while the outward side of said coffee sipping element is substantially vertical.

4. The travel lid of claim 1 wherein said sipping port element is formed integrally with said top closing surface and said continuous rim.

* * * * *